US006588594B2

(12) United States Patent
Andersen et al.

(10) Patent No.: US 6,588,594 B2
(45) Date of Patent: Jul. 8, 2003

(54) INNOVATIVE SHIPPING PACKAGE

(75) Inventors: Dale C. Andersen, Fridley, MN (US); Peter Nelson Fox, Prescott, WI (US); Bradford E. Schulz, Omaha, NE (US)

(73) Assignee: Delkor Systems, Inc., Circle Pines, MN (US)

( * ) Notice: Subject to any disclaimer, the term of this patent is extended or adjusted under 35 U.S.C. 154(b) by 58 days.

(21) Appl. No.: 09/902,971

(22) Filed: Jul. 11, 2001

(65) Prior Publication Data

US 2003/0010665 A1 Jan. 16, 2003

(51) Int. Cl.[7] ..... B65D 75/00

(52) U.S. Cl. ..... 206/497; 53/441; 206/432; 206/499; 206/526

(58) Field of Search ..... 53/398, 441, 442; 206/144, 192, 427, 432, 497, 526, 499

(56) References Cited

U.S. PATENT DOCUMENTS

| | | | | | |
|---|---|---|---|---|---|
| 3,331,503 | A | | 7/1967 | Brown | 206/65 |
| 3,347,365 | A | | 10/1967 | Funkhouser | 206/65 |
| 3,675,767 | A | | 7/1972 | Taylor | 206/65 |
| 3,883,000 | A | | 5/1975 | Gibbs | 206/432 |
| 4,036,362 | A | | 7/1977 | Ullman | 206/432 |
| 4,050,579 | A | | 9/1977 | Gorski et al. | 206/460 |
| 4,077,516 | A | * | 3/1978 | Duerr | 206/432 |
| 4,119,202 | A | * | 10/1978 | Roth | 206/432 |
| 4,304,332 | A | | 12/1981 | Danti | 206/432 |
| 4,427,108 | A | * | 1/1984 | Coles et al. | 206/497 |
| 4,919,265 | A | | 4/1990 | Lems et al. | 206/432 |
| 4,919,270 | A | * | 4/1990 | Govang et al. | 206/497 |
| 4,998,619 | A | | 3/1991 | Sowa et al. | 206/392 |
| 5,370,233 | A | * | 12/1994 | Schutz et al. | 206/597 |
| 5,887,717 | A | | 3/1999 | Anderson et al. | 206/460 |

* cited by examiner

*Primary Examiner*—Jim Foster
(74) *Attorney, Agent, or Firm*—Vidas, Arrett & Steinkraus, P.A.

(57) ABSTRACT

A container package assembly which comprises a first support member and a second support member, a plurality of containers, a top pad, and a membrane. The first support member having a first side, the second support member having a second side. The first support member and the second support member being arranged along a common plane wherein the first edge is immediately adjacent to the second edge. Each of the support members constructed and arranged to receive a predetermined number of containers thereon. A top pad positioned on top of the containers, the top pad dimensioned to extend over at least a portion of each of the support members. The support members, the predetermined number of containers and the top pad comprising an assembly, the assembly at least partially encapsulated by the membrane.

16 Claims, 5 Drawing Sheets

INNOVATIVE SHIPPING PACKAGE

BACKGROUND OF THE INVENTION

Devices for packing and shipping products and/or containers of products are known. Such devices are available in a wide variety of shapes, sizes and styles. Often a package is designed to contain a number of different containers, such as several containers of a product, in a single package for delivery from one location to another, such as from a manufacturer to a wholesaler or retail seller. Sometimes the shipping package is also used to display the product once the shipping package is opened at the retail seller.

In many cases, the package used to ship containers of product from the manufacturer to the retailer is of such type that the containers need to be removed from the package prior to displaying the containers in the retail environment. The need to remove the containers form the package is often time and labor intensive. Additionally, a separate display package may be required to display the package. The display package may be a secondary package inside the shipping package, often resulting in higher costs for the containers.

Where a package, and the containers it holds, is suitable for transitioning directly from shipping to retail display, the size of the package can be an important factor. Shelf space at the retail environment is very valuable and the retail package must be of proper size to conform to the limited space allocated for display of the package. The need for smaller display packages is increasing as products compete for increasingly limited shelf space.

The trend toward decreasing the size of the display package poses a problem for the combination shipping package which transforms into a display package. A shipping package must conform to the dynamics required to safely transport product from the manufacturer to the retail environment. The size of the shipping package is important as this package must meet common length and width requirements to be effectively palletized. If the size of the shipping package is too small, it will be become increasingly difficult to palletize and to interlock the layers of shipping packages in the pallet. This will effect the strength and durability of the pallet of product in distribution.

A smaller shipper also effects the requirements of the secondary packaging machinery at the manufacturing plant for the product. Most secondary packaging machines are designed for speed based on the number of shipping packages produced per minute. If the size of the display package causes the size and container count of the shipper to decrease, it may require a new secondary packaging machine to meet the speed requirements of the container line.

A smaller shipper is generally more costly than a larger shipper. If the size of the display package causes the shipper to decrease in both size and container count, it may result in a more cost per container for the combination shipping package and display package.

In addition to a trend toward smaller display packages, there is also a need for a display package to offer full view and access of the container to the consumer. Many display packages which also serve as shipping packages restrict the full view and access of the containers due to use of sides and lids of material, such as cardboard. In order to provide greater view and access to the containers, the cardboard material of such shipping packages must be heavily modified such as by cutting, tearing or otherwise removing one or more flaps, lids or other portions of the package. Such modification of shipping packages is inconvenient and often results in a display device which is aesthetically displeasing and which displays the containers in an undesirable manner. Such cutting of the cardboard to prepare the display may also result in damaged containers that are accidentally cut when the shipping package is modified to become a display package.

A combination shipping package which transitions to a display package usually offers a cost savings by elimination of a secondary display package and a secondary packaging line specific for a display package.

There remains a need for a cost effective low-bulk package which is capable of shipping a plurality of containers and transitions to a plurality of smaller display packages without a need for any cutting or tearing of the cardboard or other fairly rigid material of the package, and provides full consumer view and access to the containers, yet also meets the strength, durability, palletizing, and general industry standards for shipping packages of like containers to market.

Without limiting the scope of the invention, a brief summary of various embodiments of the invention is set forth below. Additional details of the summarized embodiments of the invention and/or additional embodiments of the invention may be found in the Detailed Description of the Invention below.

A brief abstract of the technical disclosure in the specification is provided as well for the purposes of complying with 37 C.F.R. 1.72.

BRIEF SUMMARY OF THE INVENTION

In one embodiment, the invention is directed to a container package assembly which includes a plurality of trays for supporting containers thereon, a top pad which is placed over the containers and at least one layer of encapsulating film which at least partially covers the combination top pad, containers and trays. The package may be used for shipping and, optionally, for retail display.

In at least one embodiment of the invention, the container package assembly comprises two or more trays which are positioned horizontally adjacent to one another. A plurality of containers are disposed on each tray and a top pad extends atop the containers over at least a portion of each of the trays. The trays, containers and top pad are at least partially encapsulated by a packaging film such as shrink-wrap, stretch-wrap, plastic or other type of thin pliable membrane. The top pad provides stability to the individual containers positioned on the trays during distribution of the shipping package as well as maintaining stability of the entire package by structurally linking the two independent trays.

The container package assemblies of the present invention desirably are sufficiently stable and strong enough to cope with the rigors of shipping as well as being of a size and bulk which allows the package assemblies to be placed in a retail setting without interfering with the consumer's ability to view and access the containers contained therein.

The container package assemblies have sufficient strength and dimensional characteristics to form interlocking layers of packages in a pallet and may be transitioned to a plurality of package assemblies which are sized to be placed in the limited shelf space of the retail setting.

Typically, the trays comprise a fairly rigid horizontal support surface. Desirably, the trays may have one or more vertical sides or walls to help retain the containers on the horizontal support surface. These side walls function to retain the containers on the horizontal support surfaces during the packaging process, during distribution, and during the transfer of the display package to the retail shelf. The walls may be of uniform height, may be tapered, or may have other configurations.

The inventive container package assembly may include one or more vertical levels of trays and containers. Where multiple vertical levels of trays are utilized, a single top pad may be placed atop the top layer of containers. It is also within the scope of the invention for a top pad to be placed between each layer of containers and the bottom surface of a vertically adjacent tray.

The top pad, in accordance with the invention, typically has a surface area equal to or less than the area of the tray positioned thereunder.

Some embodiments of the invention include encapsulating film which encapsulates less than the entire assembly of trays, containers and top pad.

The invention is also directed to a method for packaging a plurality of containers comprising the steps of providing a first support member and a second support member adjacent the first support member, the first and second support members having a plurality of containers disposed thereon, placing a top pad on top of the containers, the top pad extending over at least a portion of each of the containers and at least partially encapsulating the support members, the containers and the top pad with a film. Typically, the support members will have three sidewalls and an open side.

Further aspects of the invention will become apparent form the detailed description which follows.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

Figure 1:
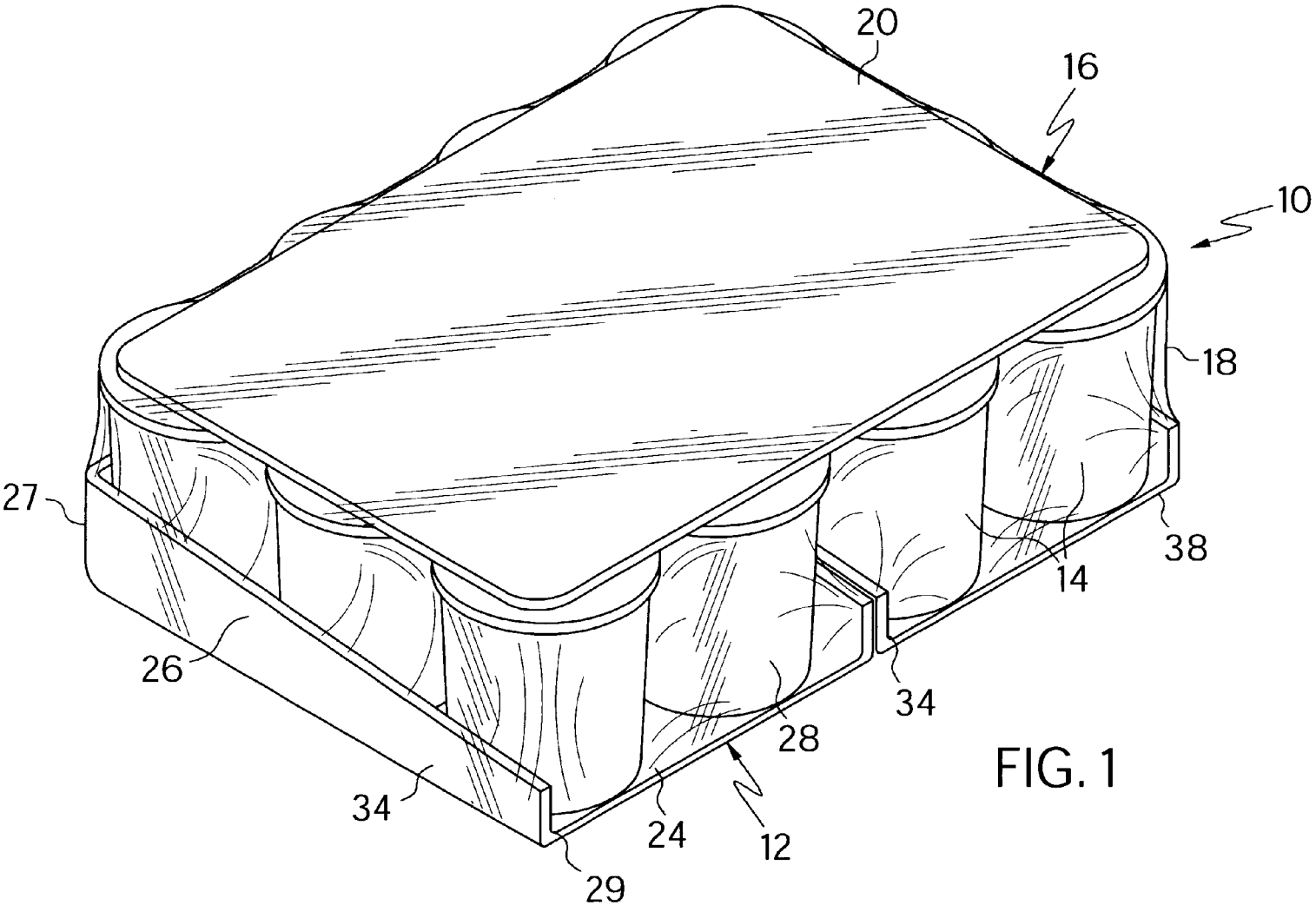
FIG. 1 is a perspective view of a first embodiment of the invention.

While this invention may be embodied in many different forms, there are described in detail herein specific embodiments of the invention. This description is an exemplification of the principles of the invention and is not intended to limit the invention to the particular embodiments illustrated.

For the purposes of this disclosure, unless otherwise indicated, identical reference numerals used in different figures refer to the same component.

An embodiment of the inventive container package assembly, is shown generally at 10 in FIG. 1. In the embodiment of FIG. 1, the container package assembly 10, comprises a pair of trays 12. Each tray 12 includes three side walls 26 and an open side. The trays 12 may be constructed of any material suitable for shipping and displaying containers 14. For example, the trays may be constructed from cardboard (corrugated or otherwise), press-board, chipboard, SBS board, wood, one or more paper product derivative, plastic, metal or other materials. Preferably, the trays are constructed from a light weight material that may be easily and inexpensively recycled or disposed of. Trays 12, support a plurality of containers 14 as shown.

The containers 14, may be arranged on the trays 12 in any manner desired. For improved stability and strength, the containers are preferably arranged in a uniform pattern of rows and or columns. Such an arrangement has the added benefit of providing ready viewability and ease of access when the trays 12 of containers 14 are placed in a retail environment.

Once the containers 14 are placed on the trays 12 in a desired arrangement, the top pad 16 is placed on top of the containers 14. The top pad 16 may have a horizontal surface 20 having an area which extends at least partially over each of the trays 12. The horizontal surface 20 of the top pad 16 may be greater than, equal to, or less than the area of the combined trays 12 positioned thereunder. Typically, the top pad will have an area slightly less than the combined area of the trays over which the top pad extends. Once the top pad 16 is in place on top of the containers 14, the combined assembly of trays 12, containers 14, and top pad 16 may be in-whole or in-part encapsulated by a film 18.

The top pad 16 forms a supporting linkage between the trays 12. The top pad 16 may further act as a cutting surface once the package 10 is received. The film 18 may be cut and opened, through application of a knife or other cutting means. The presence of the top pad 16 prevents the cutting means from contacting and damaging the containers 14 positioned thereunder. After the film 18 is cut and the package 10 opened, the top pad 16 may then be removed from the containers 14, and the two independent trays 12 may be used as shelf ready displays.

Figure 5:
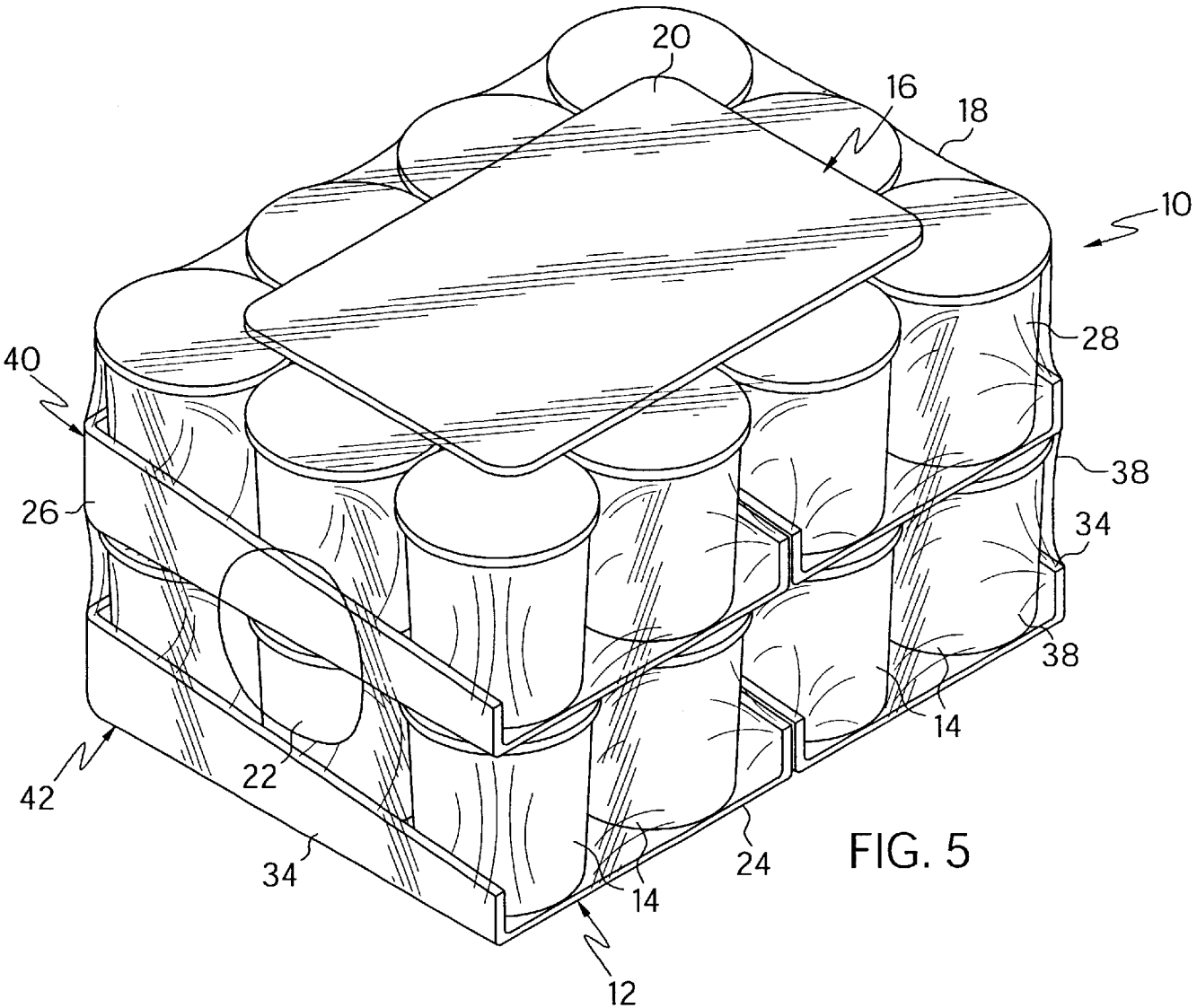
FIG. 5 is a perspective view of a fifth embodiment of the invention.

The film 18 may be any type of retaining film or material. For example the film 18 may be shrink-wrap, stretch wrap, plastic sheeting or netting, or any other type of retaining material. The film 18 may encapsulate the entire combination of trays 12, containers 14, and top pad 16, such as is shown the embodiment of FIG. 1, or alternatively, the film may have one or more openings 22 therethrough, such as is shown in FIG. 5. The film 18 may be transparent or opaque, however, a transparent film may be more preferable for retail display purposes as it is desirable to allow wholesale or retail consumers to be able to view the containers 14 even when the film 18 is in place.

Figure 2:
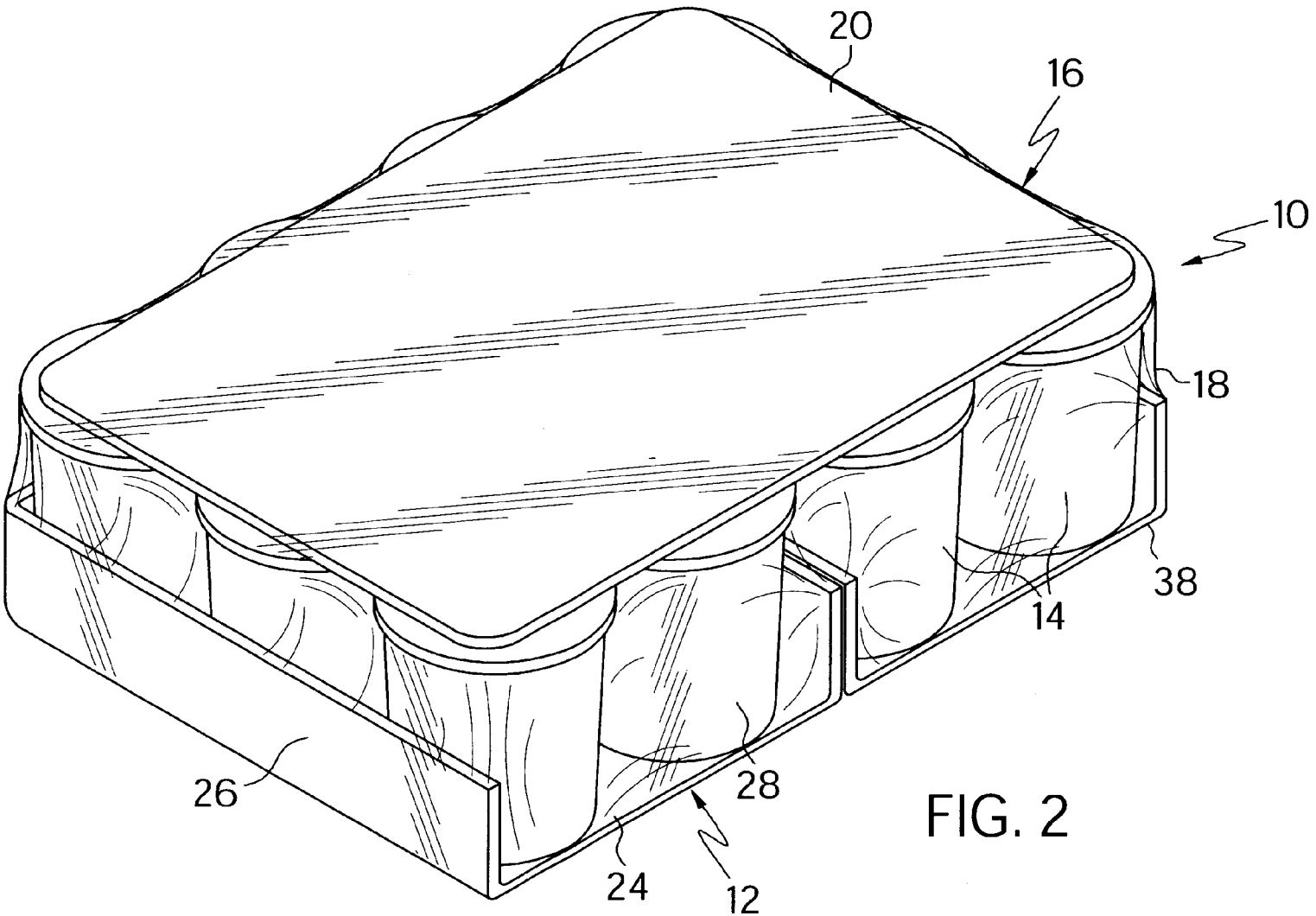
FIG. 2 is a perspective view of a second embodiment of the invention.
Figure 4:
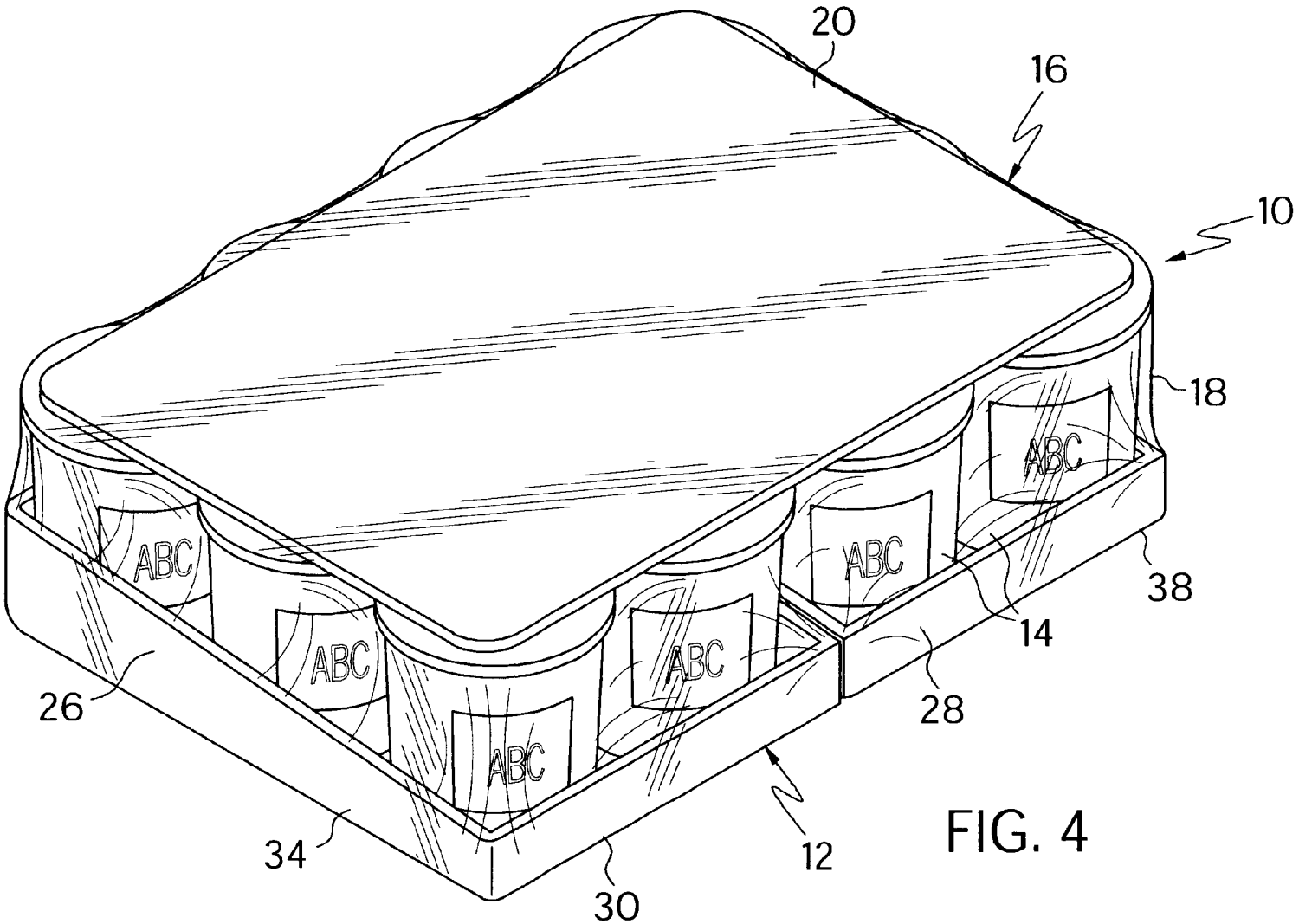
FIG. 4 is a perspective view of a fourth embodiment of the invention.

As shown in FIGS. 1, 4 and 5, each tray 12 may comprise a horizontal support surface 24 upon which the containers 12 are placed along with three side walls. A three-walled tray provides improved stability while ensuring that the front 28 of the containers 14 is fully exposed for retail viewing. Two of the side walls optionally taper from the back 27 of the tray to the front 29 the tray. The extent of the taper may vary greatly. In accordance with the invention, the side walls may also be of uniform height as shown in FIG. 2.

Figure 3:
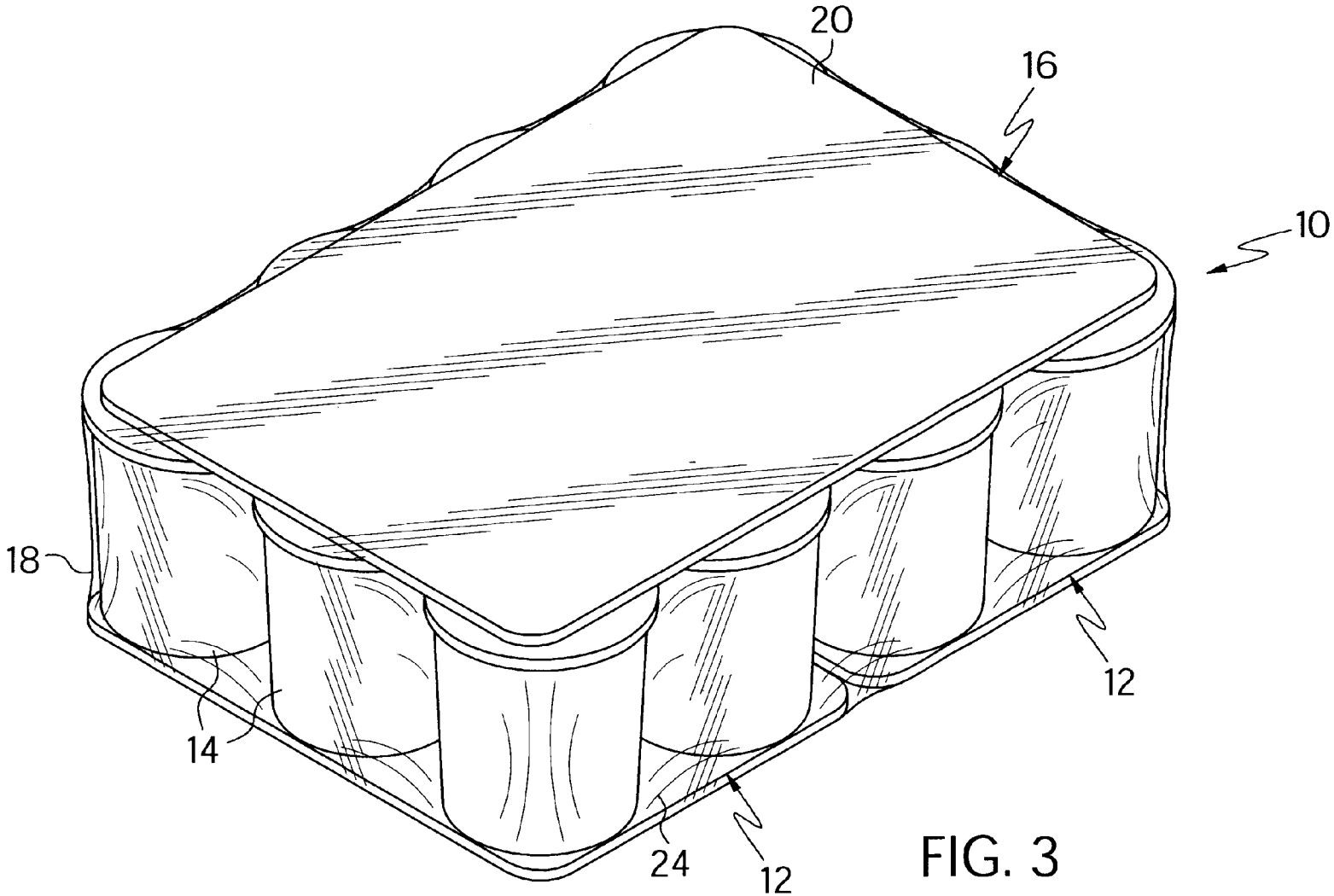
FIG. 3 is a perspective view of a third embodiment of the invention.

The trays for use in the inventive package container assembly also may comprise fewer than three side walls. As shown in FIG. 3, the tray does not include any side walls. In accordance with the invention, the tray may also be provided with two side walls or a single side wall. The inclusion of walls 26 on the trays 12, may improve the stability of the package 10, by confining the containers 14 within the confines of the tray 12. The use of walls 26 may help retain the containers 14 on the trays 12 even when the film 18 is removed.

A four-walled tray such as is shown in FIG. 4. may also be used. However, if a tray 12 is equipped with four walls 26, the front wall or lip 30 of the tray 12 is desirably less than the height of the label 32 of the container 14 to ensure proper viewing and ease of access of the containers 14 in a retail display setting.

As may be seen in FIG. 5, the container package assembly 10 may include more than one level or layer of trays 12. In the embodiment shown in FIG. 5, four trays 12 of containers 14 are arranged in two levels: atop level 40 and a bottom level 42. The bottom level 42 comprises two trays 12 of containers 14 arranged horizontally adjacent to one another in the side-by-side fashion previously described. The top level 40 comprises two more trays 12 of containers 14. The trays 12 of the top level 40 are placed directly on top of the containers 14 of the bottom level 42. Optionally, a top pad may be inserted between the containers 14 of the bottom level 42 and the trays 12 of the top level 40.

As shown, a top pad 16 is placed on top of the containers 14 of the top level 40. The entire assembly of trays 12, containers 14 and top pad 16 is encapsulated in a film 18. The film 18 may include one or more openings 22.

In the embodiment shown in FIG. 5 the top pad 16 is shown having a horizontal surface 20 which has an area less than the area of the support surface 24 of the trays 12 of the top level 40. In some embodiments, the horizontal surface 20 of the top pad 16 may have an area larger or smaller than that of the combined support surfaces 24 of a level of trays 12. In some embodiments, such as the embodiment shown in FIG. 1, the surface 20 may have an area about the same as or less than surface 24 of the combined trays 12. Desirably, the top pad has an area of at least 75% of the combined area of the trays immediately below the top pad.

The various embodiments shown in FIGS. 1–5, may be configured to accommodate containers 14 of various sizes and shapes. For example, the trays 12 may be sized to hold six containers of 6 and/or 8 oz yogurt cups. Six and eight ounce yogurt cups are traditionally shipped in 12 pack shipping packages, or larger. However, at the store level a twelve-count display may be too large to serve as a shelf-ready display. In the embodiments shown in FIGS. 1–4, the package 10 may be used as a twelve-count shipping package which includes two six-count display trays 12 once the film 18 and top pad 16 are removed. In FIG. 5 the package 10 may be used as a twenty four-count shipping package which includes four six-count display trays 12.

The sizes, shapes, numbers, and arrangement of the containers 14 illustrated in FIGS. 1–5 are shown merely as examples of the types of containers which may be packaged, shipped and displayed by the package assembly described herein. For instance, it may be desirable to configure the trays to hold between 2 and 50 containers each. Furthermore, each tray may be configured to hold equal or unequal numbers of columns and/or rows of containers. The columns and/or rows of containers may have equal or unequal numbers of containers therein. It may be further desirable to provide the containers which have a cylindrical, cubic, or some other geometric shape. Additionally, the containers may be larger in area at the bottom than at the top, or larger in area at the bottom than at the top or of constant area along the length of the container.

The invention is also directed to a method for packaging a plurality of containers comprising the steps of providing a plurality of support members including a first support member and a second support member adjacent the first support member, the first and second support members having a plurality of containers disposed thereon, placing a top pad on top of the containers, the top pad extending over at least a portion of each of the containers and at least partially encapsulating the support members, the containers and the top pad with a film. Typically, the support members will have three sidewalls and an open side. More generally, any of the support members disclosed herein may be used in the inventive method.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below (e.g. claim 4 may be taken as alternatively dependent from claim 3; claim 5 may be taken as alternatively dependent on claim 2, claim 6 may be taken as alternatively dependent from claim 4; claim 7 may be taken as alternatively dependent from claims 6, 5 or 4; etc.).

What is claimed is:

1. A container package assembly comprising:

a first support member and a second support member, the first support member having a first side, the second support member having a second side, the first support member and the second support member being arranged along a common plane wherein the first side is immediately adjacent to the second side, each of the support members further comprise at least one wall, the at least one wall having a wall length, the at least one wall being substantially perpendicular to the support surface of the support member, the at least one wall tapering in height along one or more portions of the wall length from a first height to a second height, the first height being greater than second height;

a plurality of containers, the plurality of containers positioned on a support surface of the first support member and the second support member;

a top pad, the top pad positioned on top of the containers, the top pad extending over at least a portion of each of the containers; and a film;

the support members, the plurality of containers and the top pad comprising an assembly, the assembly at least partially encapsulated by the film.

2. The container package assembly of claim 1 wherein the support surface comprises four edges, the four edges comprising a front side edge, a first side edge, a second side edge and a back side edge, the at least one wall extending along a predetermined length of at least one of the four edges.

3. The container package assembly of claim 2, the at least one wall extending along a predetermined length of at least two of the four edges.

4. The container package assembly of claim 3, the at least one wall extending along a predetermined length of at three of the four edges.

5. The container package assembly of claim 4 wherein the at least three edges comprise the back side edge, the first side edge and the second side edge.

6. The container package assembly of claim 4, the at least one wall extending along a predetermined length of the four edges.

7. The container package assembly of claim 4 wherein the at least one wall is continuous along the predetermined length of the at least three of the four edges.

8. The container package assembly of claim 1 wherein the film is a plastic membrane selected from at least one member of the group consisting of stretch-wrap, shrink-wrap.

9. The container package assembly of claim 1 further comprising a third support member and a fourth support member, the third support member having a third side, the fourth support member having a fourth side, the third support member and the fourth support member being arranged along a second common plane, wherein the third side is immediately adjacent to the forth side, the second common plane being substantially parallel to the first common plane and positioned thereunder;

additional containers being positioned on a support surface of the third support member and the forth support member;

the first support member having a first lower surface supportively engaged by the additional containers positioned on the support surface of the third support member, the second support member having a second lower surface supportively engaged by the additional containers positioned on the support surface of the forth support member.

10. The container package assembly of claim 1 wherein the film defines at least one opening.

11. The container package assembly of claim 1 wherein the top pad comprises an area, the first support member and the second support member comprising a combined support member area, the top pad area being greater than or less than the combined support member area.

12. The container package assembly of claim 11, wherein the top pad is about 75 percent greater than or less than the combined support member area.

13. The container package assembly of claim 1, wherein the plurality of containers comprises 2 to about 50 containers positioned on each of the support surfaces of the support members.

14. The container package assembly of claim 1, wherein each of the plurality of containers are substantially cylindrical in shape.

15. The container package assembly of claim 1, wherein each of the plurality of containers has a top surface area and a bottom surface area, the top surface area and the bottom surface area being unequal.

16. A method for packaging a plurality of containers comprising the steps of:

providing a plurality of support members including a first support member and a second support member adjacent the first support member, the first and second support members having a plurality of containers disposed thereon, each support member having three sidewalls and an open side;

placing a top pad on top of the containers, the top pad extending over at least a portion of each of the containers; and at least partially encapsulating the support members, the containers and the top pad with a film.

* * * * *